United States Patent [19]

Huang

[11] 4,421,133

[45] Dec. 20, 1983

[54] UMBRELLA

[76] Inventor: Yueh Huang, No. 60, Fu-Ho Rd., Yung-Ho City, Taiwan

[21] Appl. No.: 304,681

[22] Filed: Sep. 22, 1981

[51] Int. Cl.[3] ..... A45B 25/16

[52] U.S. Cl. ..... 135/22; 135/24

[58] Field of Search ..... 135/22, 23, 24

[56] References Cited

U.S. PATENT DOCUMENTS

| | | | |
|---|---|---|---|
| 192,822 | 7/1877 | Galbraith | 135/22 X |
| 2,187,372 | 1/1940 | Capaldo | 135/24 |
| 2,705,967 | 4/1955 | Zimmermann | 135/22 |
| 2,906,277 | 9/1959 | Militano | 135/22 |
| 3,658,077 | 4/1972 | Sato | 135/22 |
| 3,677,274 | 7/1972 | Yasuda | 135/24 |

FOREIGN PATENT DOCUMENTS

| | | | |
|---|---|---|---|
| 561969 | 5/1960 | Belgium | 135/24 |

*Primary Examiner*—Harland S. Skogquist

*Attorney, Agent, or Firm*—Cushman, Darby & Cushman

[57] ABSTRACT

An automatically opening and closing umbrella comprising a telescoping shaft having a middle tube, an outer tube slidably disposed over the middle tube, and two inner tubes longitudinally displaced and slidably disposed within the middle tube. Notches are provided at the top of the middle tube, the upper inner tube, and the outer tube. Between the two inner tubes is a first spring abutting against the ends thereof. A second spring is coaxially disposed over the middle tube between the notches of the middle tube and the outer tube. Locking members are provided to fix the position of the tubes, thus biasing the springs. When a first locking member is released, the first spring causes the umbrella to open. When a second locking member is released, the second spring causes the umbrella to close.

3 Claims, 9 Drawing Figures

FIG. 1(a)
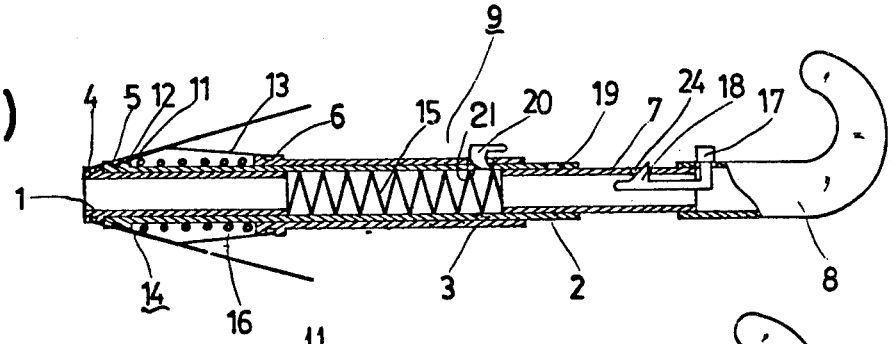
FIG. 1(b)
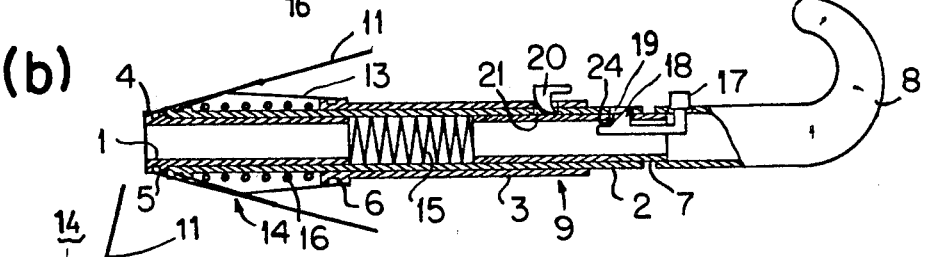
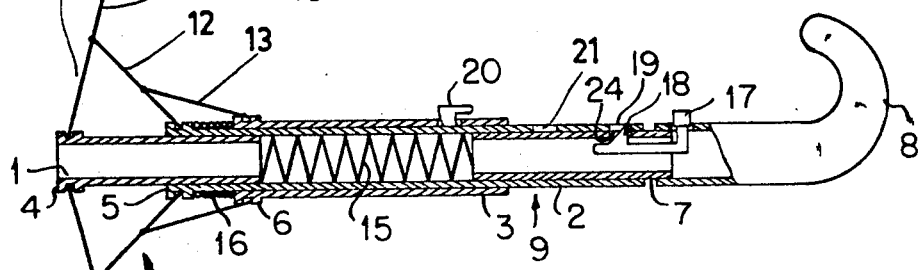
FIG. 1(c)
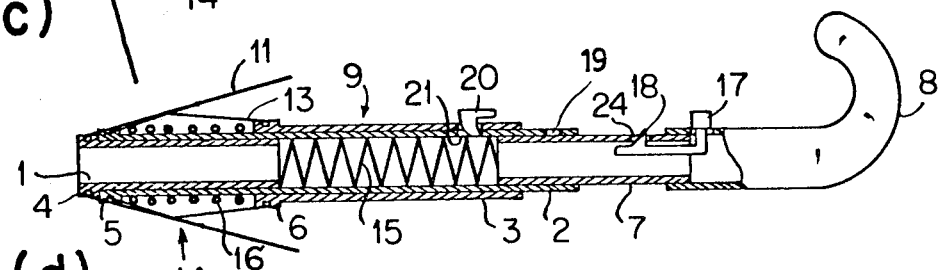
FIG. 1(d)

FIG. 2(a)
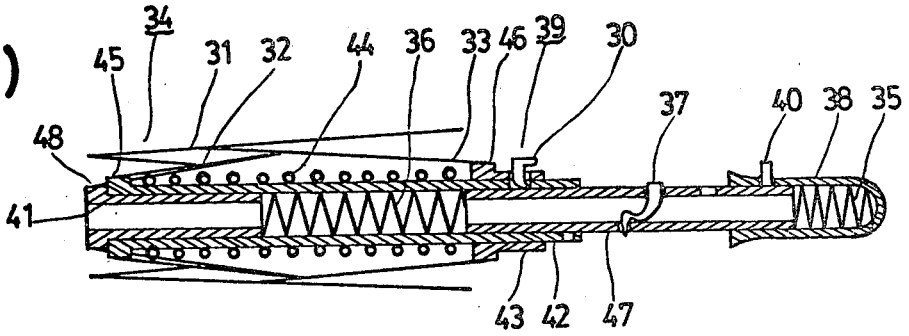
FIG. 2(b)
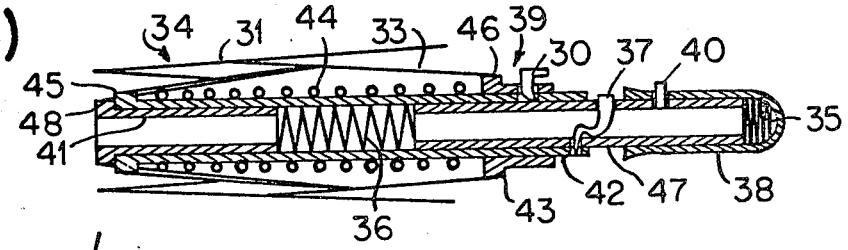
FIG. 2(c)
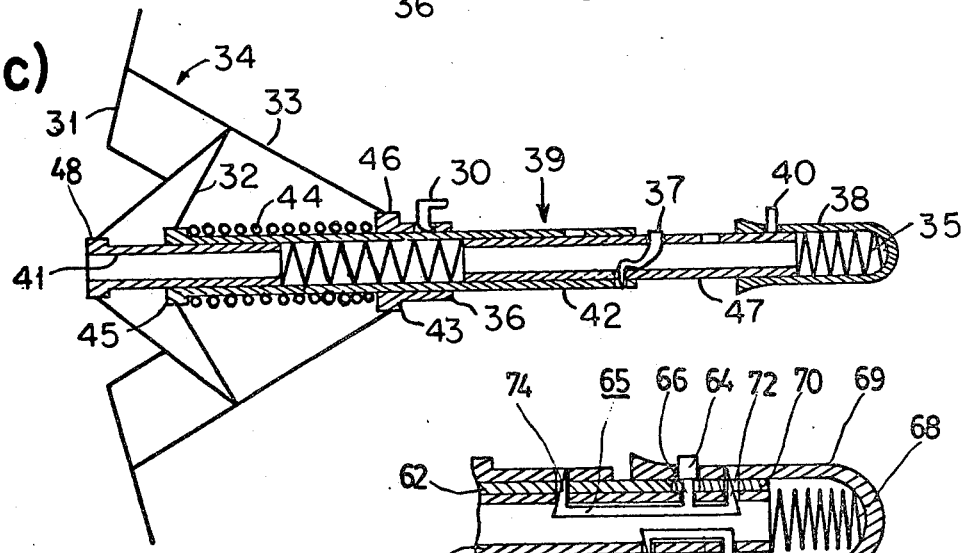
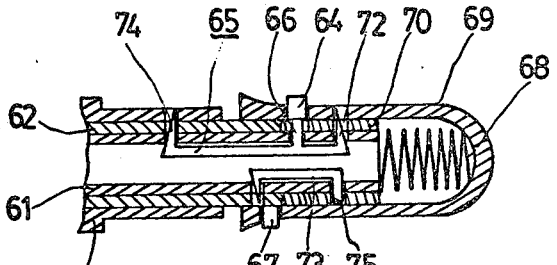
FIG. 3(a)
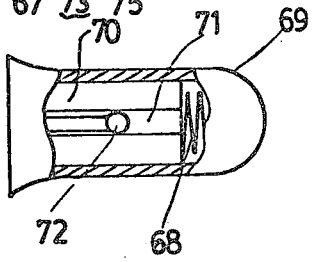
FIG. 3(b)

UMBRELLA

BACKGROUND OF THE INVENTION

The present invention relates to umbrellas, particularly to automatic umbrellas capable of self-opening and self-closing.

Conventional automatic umbrellas can only open automatically. Generally, such conventional automatic umbrellas do not include an automatic closing feature. To close conventional automatic umbrellas, it is usually necessary to slide an element of the umbrella along its shaft by hand to a lock, collapsed position. This can be somewhat strenous, since the element must be slid against the force of a spring which biases the umbrella open when the lock is released.

Therefore, the performance of such conventional automatic umbrellas is not perfect in that the convenience for the user is not maximized.

SUMMARY OF THE INVENTION

The present invention overcomes the problems with conventional automatic umbrellas by providing an automatic umbrella which both opens and closes automatically. In the present invention, two springs are provided—one for biasing the umbrella open and another for biasing the umbrella closed. By controlling the amount of force that each spring can exert by adjusting the degree to which they are compressed, one spring may be employed for opening the umbrella, while the other spring may be employed for closing the umbrella.

BRIEF DESCRIPTION OF THE DRAWINGS

These and other objects, features and advantages of the present invention will become more apparent in the following description of the preferred embodiments with reference to the accompanying drawings, in which:

FIG. 1(*a*) illustrates an umbrella of the present invention in a closed condition;

FIG. 1(*b*) illustrates the umbrella of FIG. 1(*a*) in which the inner spring is compressed;

FIG. 1(*c*) illustrates the umbrella of FIG. 1(*a*) in an open condition in which the outer spring is compressed;

FIG. 1(*d*) illustrates the umbrella of FIG. 1(*a*) returned to its original closed position;

FIG. 2(*a*) shows another embodiment of the present invention in a closed position;

FIG. 2(*b*) shows the umbrella of FIG. 2(*a*) with the locking members in their locking position and one of the springs compressed;

FIG. 2(*c*) shows the umbrella of FIG. 2(*a*) in an open position;

FIG. 3(*a*) illustrates the handle portion of a further embodiment of the present invention; and FIG. 3(*b*) shows the partial sectional view of the handle portion of FIG. 3(*a*).

DETAILED DESCRIPTION OF THE PREFERRED EMBODIMENTS

As shown in FIGS. 1(*a*) through 1(*d*), an embodiment of the present invention includes a telescoping shaft 9 formed of an outer tube 3, middle tube 2, upper inner tube 1 and lower inner tube 7. Middle tube 2 is slidably disposed within outer tube 3 and upper inner tube 1 and lower inner tube 7 are longitudinally displaced and slidably disposed within middle tube 2.

Between upper inner tube 1 and lower inner tube 7 is a spring member 15 abutting against the ends of inner tubes 1 and 7. Three notches 4, 5 and 6 are separately provided at the top of tubes 1, 2 and 3, respectively. Handle 8 is attached to the lower end of lower inner tube 7.

A plurality of main ribs 11 are pivotably attached to notch 4 and supported by stretchers 12 and 13 pivotably attached to notches 5 and 6, respectively. Main ribs 11 and stretchers 12 and 13 form a pagoda-shaped frame 14 for supporting the umbrella canopy.

A spring 16 is coaxially disposed over middle sleeve 2 and is contained between notch 5 and notch 6. When compressed, spring 16 biases notches 5 and 6 away from each other so as to exert a closing force on frame 14. To maintain frame 14 in its closed position, a locking member 20 is provided on outer tube 3 for locking positions of tubes 2 and 3 when notches 5 and 6 are separated. Locking member 20 operates through an opening 21 of tube 2. When locking member 20 is actuated, the umbrella cannot be opened.

Locking member 18 is provided to fix lower inner tube 7 with respect to middle tube 2 in a position in which lower inner tube 7 is retracted within middle tube 2. Thus, in its locked position, locking member 18 extends through openings 24 and 19 on tubes 7 and 2, respectively. When so locked, lower inner tube 7 causes spring 15 to become more compressed. This exerts a force on upper inner tube 1 to project outwardly from middle tube 2 which applies an opening force on frame 14.

To open frame 14, it is necessary to compress spring 15 by pushing handle portion 8 with respect to the top portion of shaft 9 until locking member 18 fixes the position of tube 7 with respect to tube 2. This causes spring 15 to be compressed from its relaxed position as shown in FIG. 1(*b*). When locking member 20 is deactuated so as to release tube 3 from its relative position with respect to tube 2, spring 15 will drive tube 1 outwardly. As tube 1 moves outwardly, ribs 11 pull stringers 12 and 13 causing outer tube 3 to move with respect to middle tube 2. This causes spring 16 to become compressed with respect to its natural position. The result is that frame 14 becomes opened as illustrated in FIG. 1(*c*).

When locking member 20 is released, tube 7 projects outwardly from middle tube 2 so as to reduce the force applied by spring 15. In fact, the reduction in force is sufficient so that the force of spring 16 becomes greater than that of spring 15. Accordingly, spring 16 expands, separating notches 5 and 6 which cause frame 14 to close as illustrated in FIG. 1(*d*). In this state, both springs 16 and 15 return to the original inactive position.

FIGS. 2(*a*) through 2(*c*) illustrate another embodiment of the present invention which includes a collapsible frame 34 consisting of a plurality of ribs 31 and stretchers 32 and 33 for supporting a canopy. In this embodiment, a telescoping shaft 39 includes an outer tube 43, middle tube 42 and two inner tubes 41 and 47. Middle tube 42 is slidably disposed within outer tube 43 and inner tubes 41 and 47 are longitudinally disposed within middle tube 42. Notches 48, 45 and 46 are provided at the top of inner tube 41, middle tube 42 and outer tube 43, respectively. Ribs 31 are pivotably attached to notch 48, stretchers 42 are pivotably attached to notch 45 and stretchers 33 are pivotably attached to notch 46. A spring 44 is coaxially disposed about tube 42 between notches 45 and 46. Another spring 36 is provided within tube 42 with the ends thereof abutting against the ends of tubes 41 and 47.

A locking member 30 is provided for fixing outer tube 43 relative to middle tube 42 in a position in which spring 44 is not compressed. A locking member 37 is provided inside inner tube 47 to fix middle tube 42 relative to inner tube 47 in a position to increase the compression of spring 36.

Outer tube 43 of this embodiment is shorter than outer tube 3 of the previous embodiment so that notch 46 can move to a position close to handle 38 when the umbrella is in a closed position. Inside handle 38 is a spring 35 abutting against the end of inner tube 47 to provide additional length to tube 47 when the umbrella is open and to shorten the overall length of the umbrella when the umbrella is not used. Thus, locking member 40 is provided to fix handle 38 with respect to tube 47 when spring 35 is compressed.

To open the umbrella of this embodiment, it is necessary to compress spring 36 as illustrated in FIG. 2(*b*). This is accomplished by pushing tube 47 until locking member 37 becomes actuated. Then, locking member 30 can be deactuated so that spring 36 pushes tube 41 outwardly from tube 42. This pulls ribs 31 and stringers 32 and 33 to an open position. The attachment of stringers 32 and 33 to notches 45 and 46 cause spring 44 to become compressed in this process as illustrated in FIG. 2(*c*). Locking member 44 can then be deactuated to extend handle 35. The result is a fully extended, open umbrella.

To close the umbrella, locking member 37 is actuated, releasing tension on spring 36. Spring 44 may then expand, separating notches 45 and 46, thus closing frame 34. Handle 35 may then be pushed so that locking member 40 becomes actuated with the handle and its compact position.

The embodiment of the umbrella according to the present invention illustrated in FIGS. 3(*a*) and 3(*b*) enables the umbrella to be as compact as possible.

In this embodiment, inside handle 69 is a sleeve member 70 within which inner tube 61 is slidably disposed. Longitudinally disposed from sleeve member 70 is a middle tube 62. Outer tube 63 is slidably disposed on middle tube 62.

A locking member 65 is provided inside inner tube 61 for fixing middle tube 62 relative to outer tube 63 by means of catch portion 74. At the same time, locking member 65 fixes the position of handle 69 relative to inner tube 61 by means of catch portion 72. A button 64 is provided on handle 69 for use in depressing protrusion 66 of locking member 65. Upon depressing button 64, tubes 63 and 61 will simultaneously extend upwards by the bias of springs arranged similarly to previous embodiments, placing the umbrella in an open position.

A locking member 73 is provided inside tube 61 for fixing tube 62 relative to tube 61. Locking member 73 will move upward, accompanying tube 61 as the umbrella is opened until its catch portion 75 coincides with button 67 at the instant the umbrella is opened. When the umbrella is open and button 67 is depressed, tube 62 will move upward because of the bias of a spring disposed similarly to the previous embodiments, thus causing the umbrella to close.

For the catch portion 64 and protrusion 66 to be able to move within sleeve member 70, two grooves 71 are provided on sleeve member 70 as shown in FIG. 3(*b*). After the umbrella is closed, it can be kept compact by pushing handle portion 69 against the top portion of the umbrella, until locking member 65 locks tube 63 and handle 69, as shown in FIG. 3(*a*).

With the invention thus explained, it is apparent that obvious modifications and variations can be made without departing from the scope of the invention. It is therefore intended that the invention be limited only as indicated in the appended claims.

I claim:

1. An automatic umbrella having a canopy and a frame of interconnected ribs and first and second stretchers comprising:

a telescoping shaft including a middle tube, an outer tube slidably disposed over said middle tube, an upper inner tube and lower inner tube longitudinally offset and slidably disposed inside said middle tube;

a first notch provided at an upper portion of said upper inner tube and pivotably connected to said ribs;

a second notch provided at an upper portion of said middle tube and pivotably connected to said first stretchers;

a third notch provided at an upper portion of said outer tube and pivotably connected to said second stretchers;

a first spring coaxially disposed over said shaft between said second and third notches, said first spring being compressed when said ribs and stretchers spread so as to bias said ribs and stretchers against spreading;

a second spring provided between said upper and lower inner tubes and having ends abutting against the ends of said upper and lower tubes for biasing said upper tube away from said middle tube so as to spread said ribs and stretchers;

first locking means for releasably fixing said outer tube with respect to said middle tube in a position in which said ribs and stretchers are not spread; and second locking means for releasably fixing said lower inner tube with respect to said middle tube so as to increase the compression of said second spring;

the force exerted by said second spring on said upper inner tube being stronger than the force exerted by said first spring on said middle tube when said second locking means is actuated and being weaker than the force exerted by said first spring on said middle tube when said second locking means is deactuated, so that when said first and second locking means are both actuated and said first locking means is subsequently released, said second spring urges said upper inner tube and said outer tube upward with respect to said middle tube, compressing said first spring to enable subsequent extension to close the umbrella when said second locking means is subsequently deactuated.

2. An automatic umbrella as claimed in claim 1, further comprising a handle, a third spring provided inside said handle and abutting against the end of said lower inner tube to enable said lower inner tube to extend and retract, and third locking means, provided on the handle, for locking said handle in retracted position.

3. An automatic umbrella as claimed in claim 2, wherein said third locking member is in connection with said first locking member so that said outer tube and said handle can be extended simultaneously when the umbrella is in an open position.

* * * * *